United States Patent [19]

Arnold

[11] Patent Number: 4,702,541

[45] Date of Patent: Oct. 27, 1987

[54] EXTENSION CORD CONNECTOR GUARD

[76] Inventor: Michael Arnold, 7740 Summerdale Ave., Apartment B-1, Philadelphia, Pa. 19111

[21] Appl. No.: 890,951

[22] Filed: Jul. 31, 1986

[51] Int. Cl.[4] ..... H01R 13/52

[52] U.S. Cl. ..... 439/304; 439/521

[58] Field of Search ..... 174/65 R, 65 SS, 65 G, 174/138 F, 92; 339/37, 82 R, 116 R, 116 C; 292/57

[56] References Cited

U.S. PATENT DOCUMENTS

| | | | |
|---|---|---|---|
| 368,595 | 8/1887 | King | 292/57 |
| 2,891,102 | 6/1959 | Grimes | 174/67 |
| 3,293,588 | 12/1966 | Blonder | 339/37 |
| 3,755,614 | 8/1973 | Jakacki | 174/65 R |
| 3,787,605 | 1/1974 | Van Gessel et al. | 174/65 |
| 3,869,189 | 3/1975 | McCurdy | 339/116 C |
| 4,063,110 | 12/1977 | Glick | 174/67 |
| 4,229,616 | 10/1980 | Hotchkiss | 174/65 R |
| 4,304,958 | 12/1981 | Neff et al. | 174/65 R |
| 4,381,063 | 4/1983 | Leong | 174/67 |
| 4,382,649 | 5/1983 | Meyer | 339/39 |
| 4,389,535 | 6/1983 | Slater et al. | 174/65 R |
| 4,419,537 | 12/1983 | Leep et al. | 174/65 R |
| 4,449,015 | 5/1984 | Hotchkiss et al. | 174/65 R |
| 4,451,101 | 5/1984 | Davis | 174/67 |
| 4,488,764 | 12/1984 | Pfenning et al. | 339/37 |

*Primary Examiner*—John McQuade

*Attorney, Agent, or Firm*—Steele, Gould & Fried

[57] ABSTRACT

An extension cord connector guard includes a substantially closed housing and reclosable structure for accessing the interior of the housing. A pair of opposed cord access ports are provided in the housing side walls to permit the placement and removal of end portions of extension cords in the housing without interference with the function of the access structure. A child resistant lock structure secures the reclosable structure in the closed position. Cord port size adjustment gates and suitable moisture resistant gaskets are preferably provided to adjust the port dimensions to suit the particular cords which are used and to prevent the entrance of water into the housing interior.

4 Claims, 5 Drawing Figures

EXTENSION CORD CONNECTOR GUARD

BACKGROUND OF THE INVENTION

1. Field of the Invention

This invention relates generally to safety devices for electrical cord connections, and more particularly is directed to a moisture resistant and child resistant electrical connection box to secure therewithin the interconnecting structures of a pair of joined electrical cords.

2. Description of the Prior Art

Extension cords have long been utilized to provide a useful and practical electrical connection between conventional electrical outlets or receptacles and remote electrical equipment. The connection between the equipment cords and the extension cords, or between joined pairs of extension cords, is usually susceptible to tampering by children. In outdoor or wet locations, the possibility of ground water reaching the cord interconnection could present a considerable shock hazard.

Most local and national electrical safety codes require that all interconnections between permanently installed wires or conductors be mechanically isolated and protected, to thereby provide a reliable degree of safety. Accordingly, it is the usual practice to provide closed junction boxes of various designs at all wiring interconnections to thereby protect occupants and buildings from unreasonable risk of electrical fire or shock. However, so far as is known to the applicant, there is no similar requirement or custom with regard to temporary wiring, such as extension cords.

Accordingly, it is now the usual practice when using extension cords to simply electrically interconnect the plug at one end of a first cord with a suitable receptacle provided at the end of a second cord. The interconnection is normally not protected in any manner and therefore is easily accessible to children, animals and the like. When employed out of doors or in damp locations, such interconnection is susceptible to contact by ground water or other moisture.

SUMMARY OF THE INVENTION

It is an object of the present invention to provide a closable receptacle which will enclose the junction between interconnected electrical cords in a manner to discourage tampering by children.

It is another object of the present invention to provide a closable receptacle which will accommodate cords of different diameters in a mechanically secured and moisture resistant manner.

It is another object of the present invention to provide a portable extension cord connector guard that is simple in design, rugged in construction and reliable when in use.

These and other objects are accomplished by employing an extension cord connector guard in which a hollow housing or body is provided with reclosable means for accessing the interior of the housing. At least two electrical cord ports are provided in spaced locations in the housing to receive and secure end portions of at least a pair of electrical cords near their common interconnection. The ports permit placement of the end portions and connection members of connected extension cords, such as male and female plug members, into the interior of the housing in a sealed and secure manner. Suitable structure is provided at each of the ports to permit size adjustment of the ports to thereby accommodate extension cords of varying wire gauge and insulation thickness.

The port adjustment structure is preferably constructed as a pivoting closure member or gate which can latch in more than one position in a manner to vary the effective size of the port. In one embodiment, the closure member can be a flat plate with an opening smaller in size than the cross sectional dimension of the port.

In a preferred embodiment, the closure plate is preferably mounted upon a pivot post affixed on the housing or body so that the plate can pivot to cover the port in a first position and can be substantially pivoted to cover the port in a first position and can be substantially pivoted away from the port in another position. The closure plate preferably includes a latch or other structure suitable to retain it in the proper position to mechanically secure the associated electrical wire. The latch structure could be a hook means designed to engage a post or could include other types of easily secured locking constructions. The hook means could be double-sided for two position latching, if so desired.

The structure for accessing the interior of the housing is preferably designed as a lid or door which can be hingeably mounted upon the housing. The lid or door is pivotal between an open position to permit placement of the cord connectors within the housing and a closed position wherein the cord connectors are shielded, preferably in a child resistant and moisture resistant manner.

Alternative access means to access the housing interior could also be provided, for example, by employing integral, opposed tracks and suitable sliding door means within the tracks.

In a preferred embodiment, a moisture resistant and child-resistant locking structure is provided to secure the access structure or lid in the closed and locked position. A rotatable latch can be secured on either the access structure or the housing and passes through an opening provided through the other to permit movement of the access structure relative to the housing. The latch is designed so that it cannot move through the opening in other positions, thereby securing the lid in a child resistant interconnection. Biasing means in the form of a spring can also be provided to resist rotation of the latch to render the device child resistant and to automatically return the latch to the non-removal position. Additionally, suitable resilient sealing means can be interposed between the lid and the housing body and at the ports and port adjustment structures in an manner to discourage the entrance of water or moisture into the interior of the housing when the device is in use.

Other objects and a fuller understanding of the invention will be had by referring to the following description and claims of a preferred embodiment thereof, taken in conjunction with the accompanying drawings, wherein like reference characters refer to similar parts throughout the several views and in which:

DESCRIPTION OF THE PREFERRED EMBODIMENT OF THE INVENTION

Figure 1:
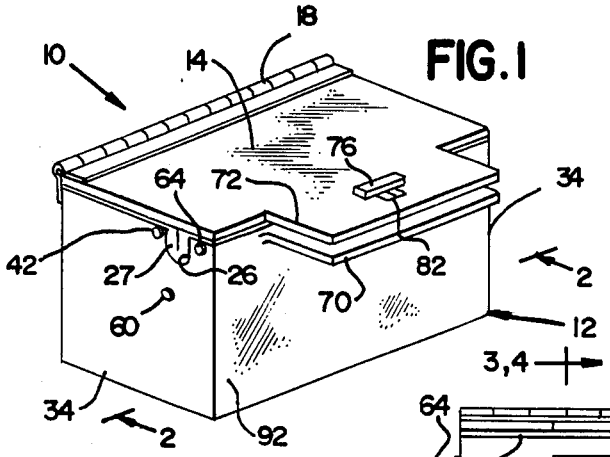
FIG. 1 is a perspective view of a portable extension cord connector guard constructed in accordance with the techings of the present invention and showing the latching mechanism in the locked position.

Although specific terms are used in the following description for the sake of clarity, these terms are intended to refer only to the particular structure of the invention selected for illustration in the drawings, and are not intended to define or limit the scope of the invention.

Referring now to the drawings, the connector guard 10 comprises generally a housing or body such as box 12 and an openable access structure such as a lid 14. The box 12 preferably is fabricated to suitable cross sectional dimensions to prevent tipping and of sufficient size to accommodate joined male and female plug connectors therewithin. The lid 14 can be hingeably mounted to the box 12 in known manner by employing one or more hinges 18. A peripheral, resilient gasket 16 or other suitable seal can be used to waterproof the juncture between the access structure or lid 14 and the housing body 12. As illustrated, the housing is provided with at least two spaced extension cord ports 26 to receive and retain portions of electrical extension cords therein. The cord ports 26 are formed in spaced locations elsewhere in the box. The spaced cord ports 26 preferable are formed as upwardly open channels as illustrated to receive end portions of the electrical cords to be joined (not illustrated) therein.

The ports 26 are therefore dimensioned to be larger than the diameter of any cord which is anticipated to be accommodated by the connector guard 10. With end portions of the respective electrical cords (not shown) positioned within the opposed ports 26, the male and female cord connectors (also not shown) can be readily positioned within the hollow interior 22 of the housing or box 12 in a manner to discourage tampering by children.

The access structure or lid 14 permits reclosable access to the interior 22 of the box 12 for placing the electrical connectors into protected position within the housing interior. The access lid 14 when closed permits each electrical cord to extend outwardly from its respective access port 26. The electrical interior connection between the joined cords (not shown) is thereby shielded from weather and from separation by sudden jolts and jars. More importantly, the connection is shielded from the sight and reach of children, thereby to prevent accidental shock or more serious consequences.

Figure 3:
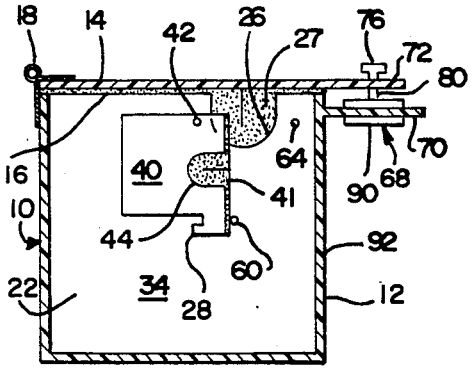
FIG. 3 is a cross sectional view taken along line 3—3 on FIG. 2, showing the port size adjustement structure in a first position.
Figure 4:
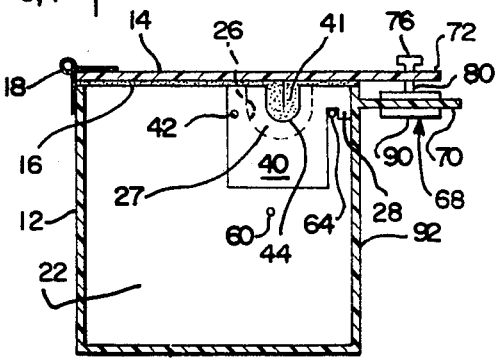
FIG. 4 is a cross sectional view similar to FIG. 3 but showing the port adjustment structure in a second position.

Adjustment structure, for example, a pivoting gate or closure member 40 is provided adjacent to each port 26 for varying the effective size of each of the ports in a manner to accommodate extension cords of different dimension. The closure members 40 can be pivotally mounted on pivot posts 42 in such a manner that in a first position, the closure member 40 is pivoted away from the access port 26 (FIG. 3). In a second pivotal position, the closure member 40 will at least partially cover the port 26 (FIG. 4.) The closure member is preferably constructed with an opening 44 of smaller dimensions than the cord port 26 to facilitate securing and sealing a conductor or wire of a smaller gauge. As illustrated, the closure member opening 44 aligns with the cord port 26 when the closure member is pivoted to the said second position to thereby reduce the effective size of the conductor opening.

The openings 26, 44 can preferably be formed as upwardly open U-shaped grooves. It is also possible to otherwise shape and dimension the openings 26, 44 to receive and retain the conductors (not shown) in an effective manner. The closure members 40 can be made detachable relative to the pivot posts 42 in known manner so that alternative closure members having openings of various sizes may be interchanged, depending upon the extension cord diameter and shape. As best seen in FIG. 3, the side wall ports or openings 26 are provided with split resilient gaskets or seals 27 and the closure member openings 44 are similarly equipped with split gaskets 41. In this manner, the entrance of moisture or water into the body interior 22 will be discouraged.

The closure members 40 can be held in their respective pivotal positions by utilizing suitable latch means. As shown, each closure member 40 is formed with a hook portion 28 which is adapted to engage a cooperating structure in the body 12, for example, a latch post 64. The hook portion 28 is preferably positioned opposite that portion of the closure member 40 which engages the pivot post 42. A second latch post 60 can be provided in the body side wall to engage and retain the closure member 40 in a pivotal position that is clear of the cord port 26. The latch post 64 should be positioned in the body side wall so as to engage the hook portion 28 to retain the closure member 40 and its opening 44 in alignment over the cord port 26. See FIG. 4. It is also possible to provide additional latch posts to position the closure member at intermediate points if so desired.

Figure 2:
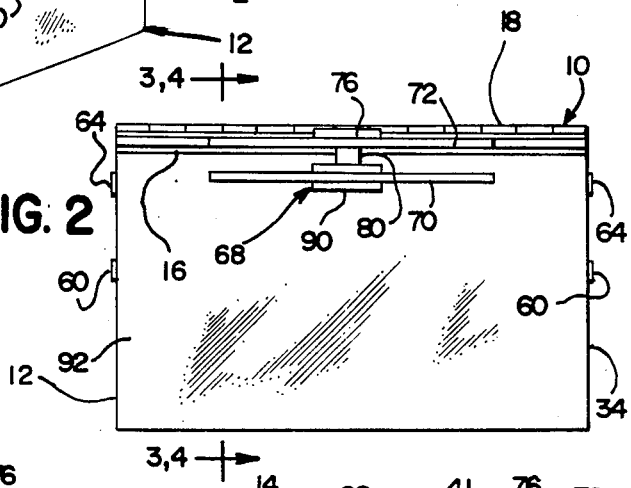
FIG. 2 is a front elevational view of the guard, looking from line 2—2 in FIG. 1.
Figure 5:
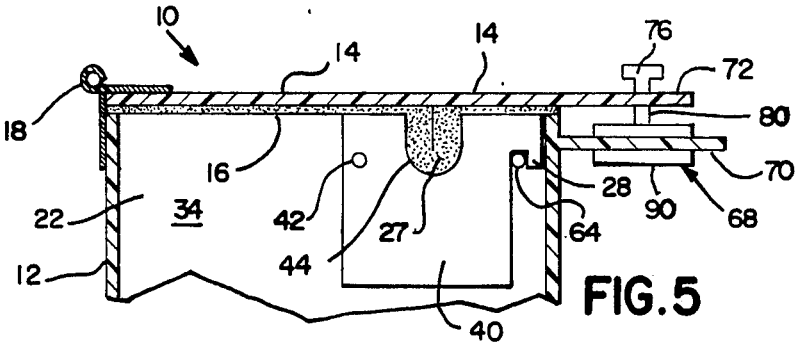
FIG. 5 is an enlarged, partial, cross sectional view of a closure of the present member and the child-resistant locking structure constructed according to the teachings of the present invention and showing the latching mechanism in the opening position.

The portable extension cord connector guard 10 of the present invention includes a lockable closure such as lid 14 to prevent children from accessing the electrical connection after it is positioned within the interior cavity 22 of the hollow box or body 12. This can be accomplished by employing a suitable child-resistant locking structure, for example, a rotatable latching means 68. Referring now to FIGS. 1, 2 and 5, it will be seen that the cover or lid 14 terminates forwardly in an upper flange 72 of shape to facilitate grasping and lifting when it is desired to gain access to the interior 22 of the hollow body 12. A cooperating lower flange 70 extends from the front wall 92 of the body 12 and registers beneath the upper flange 72. The latching means 68 is rotatable relative to the lower flange 70 and comprises generally a base 90, a shaft 80 which integrally extends upwardly from the base and an upper, elongate, integral latch 76.

In a preferred embodiment, the upper flange is provided with an elongated opening 82. The opening 82 is formed of suitable configuration and dimensions to receive therethrough the elongated latch 76 of the latching means 68. When the latching means is rotated relative to the lower flange 70, for example, by grasping and turning the base 90, the latch cannot fit through the lid opening 82 and the body 12 will be effectively locked. FIG. 1 illustrates the position of the latching means 68 when rotated to the locked position. It is contemplated that a spring or other construction could be employed to normally urge the latching means to its locked position.

In use, the latching means 68 must be rotated until the axis of the latch coincides with the longitudinal axis of the lid opening 82. With the parts thus aligned, the lid 14 can be pivoted about the hinge 18 to expose the interior 22 of the body 12 to facilitate placement of the electrical cord connectors (not illustrated) therewithin. Once the electrical cords and connectors have been properly positioned relative to the connector guard 10, the cover or lid 14 should be pivoted about the hinge 18 to register the upper flange 72 over the lower flange 70. With the parts thus positioned, the latching means 68 can be rotated as necessary to position the latch 76 through the lid opening 82. Upon rotation of the latching means to the position illustrated in FIG. 1, the connection guard 10 will be effectively closed and latched. To open the lid 14, the latching means must be rotated until the longitudinal axis of the latch coincides with the longitudinal axis of the lid opening. With the latching means thus positioned, the lid flange 72 can be grasped and raised to thereby expose the body interior 22.

Although the present invention has been described with reference to the particular embodiments herein set forth, it is understood that the present disclosure has been made only by way of example and that numerous changes in the details of the construction may be resorted to without departing from the spirit and scope of the invention. Thus, the scope of the invention should not be limited by the foregoing specification, but rather, only by the scope of the claims appended hereto.

What is claimed is:

1. An extension cord connector guard for protecting the interconnected ends of electrical cords comprising:

a substantially closed housing, said housing being provided with reclosable means for accessing the interior of said housing, the reclosable means being movable between a first position wherein the housing interior is exposed and a second position wherein the housing is closed;

at least two extension cord ports provided in said housing, said ports comprising means for adjusting the effective size of said ports and first sealing means to prevent the entrance of water into the housing interior through the said ports, the first sealing means comprising a resilient seal secured within a said cord port, the means for adjusting comprising a closure member movable secured to the housing, the closure member being movable between a first position wherein at least part of a cord port is covered and a second position wherein the cord port is uncovered, the said closure member comprising at least one hook portion and a first post mounted on said housing for engaging said hook portion and retaining said closure member in the first position; and latch means for retaining the said reclosable means in the said second position in a substantially child resistant manner.

2. The extension cord connector guard of claim 1 wherein said closure member is provided with an opening, said opening aligning with a cord port when the closure member is moved to the said first position.

3. The extension cord connector guard of claim 1 wherein said closure member further comprises means on said closure member which is adapted to engage a second post extending from said housing to retain the closure member in the second position.

4. The extension cord connector guard of claim 1 and second sealing means to prevent the entrance of water into the housing interior intermediate the housing and the reclosable means, the second sealing means comprising a peripheral resilient gasket secured to one of the housing or the reclosable means.

* * * * *